US010215175B2

(12) United States Patent
Ignatiev et al.

(10) Patent No.: US 10,215,175 B2
(45) Date of Patent: Feb. 26, 2019

(54) COMPRESSOR HIGH-SIDE AXIAL SEAL AND SEAL ASSEMBLY RETAINER

(71) Applicant: Emerson Climate Technologies, Inc., Sidney, OH (US)

(72) Inventors: Kirill M. Ignatiev, Sidney, OH (US); Jeffrey L. Berning, Fort Laramie, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 15/222,361

(22) Filed: Jul. 28, 2016

(65) Prior Publication Data

US 2017/0037850 A1 Feb. 9, 2017

Related U.S. Application Data

(60) Provisional application No. 62/200,702, filed on Aug. 4, 2015.

(51) Int. Cl.
*F04C 27/00* (2006.01)
*F04C 18/02* (2006.01)
(Continued)

(52) U.S. Cl.
CPC ..... *F04C 27/003* (2013.01); *F04C 18/0215* (2013.01); *F04C 27/008* (2013.01);
(Continued)

(58) Field of Classification Search
CPC ..... F04C 27/00; F04C 18/02; F04C 29/00; F01C 17/06
(Continued)

(56) References Cited

U.S. PATENT DOCUMENTS 4,300,875 A 11/1981 Fischer et al.
4,325,683 A 4/1982 Miyazawa
(Continued)

FOREIGN PATENT DOCUMENTS

CN 1186174 A 7/1998
CN 1632317 A 6/2005
(Continued)

OTHER PUBLICATIONS

First Notification of Making Rectification issued by The State Intellectual Property Office of the People's Republic of China on Aug. 9, 2013, regarding Application No. 201320233026.1. Translation provided by Unitalen Attorneys at Law.
(Continued)

*Primary Examiner* — Mary A Davis
*Assistant Examiner* — Deming Wan
(74) *Attorney, Agent, or Firm* — Harness, Dickey & Pierce, P.L.C.

(57) ABSTRACT

A compressor may include a non-orbiting scroll, an orbiting scroll, a drive shaft, a bearing housing and an annular seal. The non-orbiting scroll includes a first spiral wrap. The orbiting scroll includes an end plate having a second spiral wrap ending from a first side of the end plate and an annular hub extending from a second side of the end plate. The first and second spiral wraps cooperate to compress working fluid from a suction pressure to a discharge pressure. The drive shaft includes a crankpin received in the hub and drives the orbiting scroll. The bearing housing rotatably supports the drive shaft and may define a biasing chamber containing working fluid biasing the orbiting scroll toward the non-orbiting scroll in an axial direction. The annular seal may engage a diametrical surface of the hub and engage the bearing housing, thereby defining the biasing chamber.

20 Claims, 7 Drawing Sheets

(51) Int. Cl.
*F04C 29/00* (2006.01)
*F01C 17/06* (2006.01)
*F04C 23/00* (2006.01)

(52) U.S. Cl.
CPC ..... *F04C 23/008* (2013.01); *F04C 29/0057* (2013.01); *F04C 2240/50* (2013.01)

(58) Field of Classification Search
USPC ..... 418/55.4, 55.1, 104, 140, 143, 144
See application file for complete search history.

(56) References Cited

U.S. PATENT DOCUMENTS

| | | | | |
|---|---|---|---|---|
| 4,435,137 | A | 3/1984 | Terauchi | |
| 4,877,382 | A | 10/1989 | Caillat et al. | |
| 4,993,928 | A | 2/1991 | Fraser, Jr. | |
| 5,295,813 | A | 3/1994 | Caillat et al. | |
| 5,370,513 | A | 12/1994 | Fain | |
| 5,378,129 | A | 1/1995 | Dunaevsky et al. | |
| 5,520,524 | A | 5/1996 | Takemoto et al. | |
| 5,545,019 | A | 8/1996 | Beck et al. | |
| 6,079,962 | A | 6/2000 | Seibel et al. | |
| 6,089,840 | A | 7/2000 | Iizuka et al. | |
| 6,106,251 | A | 8/2000 | Monnier et al. | |
| 6,139,295 | A * | 10/2000 | Utter | F01C 17/06 418/55.5 |
| 6,146,119 | A | 11/2000 | Bush et al. | |
| 6,189,248 | B1 | 2/2001 | Nagel et al. | |
| 6,398,530 | B1 | 6/2002 | Hasemann | |
| 6,428,294 | B1 | 8/2002 | Fenocchi | |
| 6,454,551 | B2 | 9/2002 | Kuroki et al. | |
| 6,695,600 | B2 | 2/2004 | Koo et al. | |
| 6,709,247 | B1 | 3/2004 | Clendenin et al. | |
| 6,821,092 | B1 | 11/2004 | Gehret et al. | |
| 7,273,363 | B1 | 9/2007 | Sun et al. | |
| 7,338,263 | B2 | 3/2008 | Young | |
| 7,661,939 | B2 | 2/2010 | Su et al. | |
| 8,186,981 | B2 | 5/2012 | Sugimoto et al. | |
| 9,115,718 | B2 | 8/2015 | Ignatiev et al. | |
| 9,188,124 | B2 | 11/2015 | Utpat et al. | |
| 2002/0057975 | A1 | 5/2002 | Nakajima et al. | |
| 2003/0077193 | A1 | 4/2003 | Skinner | |
| 2004/0184931 | A1 | 9/2004 | Millet et al. | |
| 2007/0092390 | A1 | 4/2007 | Ignatiev et al. | |
| 2009/0246057 | A1 | 10/2009 | Sugimoto et al. | |
| 2010/0111709 | A1 | 5/2010 | Jayanth | |
| 2012/0258003 | A1 | 10/2012 | Hahn | |
| 2014/0219850 | A1 | 8/2014 | Ignatiev et al. | |
| 2015/0361983 | A1 | 12/2015 | Ignatiev et al. | |
| 2016/0069348 | A1 | 3/2016 | Utpat et al. | |

FOREIGN PATENT DOCUMENTS

| | | | |
|---|---|---|---|
| CN | 101255864 | A | 9/2008 |
| CN | 101545483 | A | 9/2009 |
| CN | 101576072 | A | 11/2009 |
| CN | 101684811 | A | 3/2010 |
| CN | 203453056 | U | 2/2014 |
| CN | 203822627 | U | 9/2014 |
| EP | 1253323 | B1 | 3/2005 |
| JP | 2000161256 | A | 6/2000 |
| JP | 2009114943 | A | 5/2009 |
| JP | 2012132409 | A | 7/2012 |
| KR | 100996628 | B1 | 11/2010 |
| WO | WO-9410425 | A1 | 5/1994 |
| WO | WO-2010113794 | A1 | 10/2010 |

OTHER PUBLICATIONS

International Search Report regarding U.S. Patent Application No. PCT/US2014/012319, dated Apr. 28, 2014.
Written Opinion of the International Searching Authority regarding Application No. PCT/US2014/012319, dated Apr. 28, 2014.
Office Action regarding U.S. Appl. No. 14/159,526 dated Oct. 1, 2014.
Final Office Action regarding U.S. Appl. No. 14/159,526 dated Feb. 3, 2015.
Office Action regarding U.S. Appl. No. 13/869,567, dated Mar. 25, 2015.
Office Action regarding Chinese Patent Application No. 201310158952.1, dated May 5, 2015. Translation provided by Unitalen Attorneys at Law.
Office Action regarding Chinese Patent Application No. 201480005721.X, dated Jul. 15, 2016. Translation provided by Unitalen Attorneys at Law.
Office Action regarding Chinese Patent Application No. 201610157658.2, dated Sep. 26, 2017. Translation provided by Unitalen Attorneys at Law.
Office Action regarding U.S. Appl. No. 14/832,371 dated Feb. 1, 2018.
Office Action regarding Indian Patent Application No. 1344/MUM/2012, dated Feb. 12, 2018.
Office Action regarding U.S. Appl. No. 14/941,827 dated Mar. 15, 2018.
International Search Report regarding International Application No. PCT/US2016/045180, dated Oct. 12, 2016.
Written Opinion of the International Searching Authority regarding International Application No. PCT/US2016/045180, dated Oct. 12, 2016.
Office Action regarding Chinese Patent Application No. 201610157658.2, dated May 30, 2018. Translation provided by Unitalen Attorneys at Law.
Office Action regarding Chinese Patent Application No. 201710426869.6, dated Aug. 1, 2018. Translation provided by Unitalen Attorneys at Law.
Office Action regarding U.S. Appl. No. 14/832,371, dated Aug. 24, 2018.
Office Action regarding Chinese Patent Application No. 201680051384.7, dated Nov. 14, 2018. Translation provided by Unitalen Attorneys at Law.

* cited by examiner

COMPRESSOR HIGH-SIDE AXIAL SEAL AND SEAL ASSEMBLY RETAINER

CROSS-REFERENCE TO RELATED APPLICATIONS

This application claims the benefit of U.S. Provisional Application No. 62/200,702, filed on Aug. 4, 2015. The entire disclosure of the above application is incorporated herein by reference.

FIELD

The present disclosure relates to a compressor high-side axial seal and seal assembly retainer.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a non-orbiting scroll, an orbiting scroll, a drive shaft, a bearing housing and a first annular seal. The non-orbiting scroll includes a first spiral wrap. The orbiting scroll includes an end plate having a second spiral wrap ending from a first side of the end plate and an annular hub extending from a second side of the end plate. The first and second spiral wraps cooperate to compress working fluid from a suction pressure to a discharge pressure. The drive shaft includes a crankpin received in the hub and drives the orbiting scroll in an orbital path relative to the non-orbiting scroll. The bearing housing rotatably supports the drive shaft and may define a biasing chamber containing working fluid biasing the orbiting scroll toward the non-orbiting scroll in an axial direction. The first annular seal may engage a diametrical surface (e.g., a cylindrical surface) of the hub and may engage the bearing housing, thereby defining the biasing chamber.

In some configurations, the working fluid is disposed within the biasing chamber is at an intermediate pressure between the suction pressure and the discharge pressure. The first annular seal may separate the intermediate-pressure working fluid from discharge-pressure working fluid disposed in a space radially inward relative to the first annular seal.

In some configurations, the first annular seal defines an annular space (e.g., an annular groove or recess) in which a second annular seal is disposed. The second annular seal sealingly may engage the first annular seal and the hub.

In some configurations, the second annular seal sealingly engages said diametrical surface of the hub.

In some configurations, the second annular seal sealingly engages an axial end surface of the hub.

In some configurations, an axially extending portion of the first annular seal includes a radially inwardly extending protrusion that is received in an annular groove formed in the hub.

In some configurations, the compressor includes a spring disposed within the annular space in the first annular seal and biasing the second annular seal into engagement with the axial end surface.

In some configurations, the compressor includes a stop ring disposed between the first annular seal and the end plate. The stop ring may extend around the hub and abut an annular ledge formed in the hub.

In some configurations, the compressor includes a spring disposed between the stop ring and the first annular seal and biasing the first annular seal and the stop ring away from each other in an axial direction.

In some configurations, the compressor includes a second annular seal disposed radially inward relative to at least a portion of the first annular seal. The second annular seal may sealingly engage the first annular seal and the hub.

In some configurations, the compressor includes an annular seal retainer extending around the hub and cooperating with the hub to define an annular cavity disposed radially therebetween. The stop ring, the spring and a portion of the first annular seal may be disposed within the annular cavity.

In some configurations, the seal retainer is slidable along the hub in an axial direction and includes an axial end having a radially inwardly extending lip that snaps into engagement with a radially outwardly extending lip of the first annular seal.

In some configurations, the first and second annular seals, the spring, the stop ring, and the seal retainer may extend around outer diametrical surfaces of the hub of the orbiting scroll.

In some configurations, the first and second annular seals, the spring, and the stop ring may be at least partially disposed within the seal retainer.

In some configurations, the second annular seal sealingly engages another annular ledge of the hub.

In some configurations, the second annular seal includes a generally U-shaped cross section that is exposed to discharge-pressure working fluid that spreads the U-shaped cross section open to seal the second annular seal against the hub and the first annular seal.

In some configurations, the non-orbiting scroll sealingly engages the bearing housing at a location (e.g., at an annular seal sealingly engaging the non-orbiting scroll and the bearing housing) disposed radially outward relative to the first annular seal such that the biasing chamber is disposed radially between the first annular seal and the location.

In some configurations, the working fluid disposed within the biasing chamber is at an intermediate pressure between the suction pressure and the discharge pressure. The first annular seal may separate the intermediate-pressure working fluid from discharge-pressure working fluid disposed in a space radially inward relative to the first annular seal.

In some configurations, the diametrical surface of the hub is an outer diametrical surface (e.g., an outer cylindrical surface).

In some configurations, the diametrical surface of the hub is an inner diametrical surface (e.g., an inner cylindrical surface).

In some configurations, the compressor includes a bearing received in the hub and engaging the inner diametrical surface. The bearing may surround the crankpin.

In some configurations, the first annular seal includes an axially extending portion and a radially extending portion extending radially outward from the axially extending portion. The axially extending portion may extend around and engages the inner diametrical surface of the hub. The radially extending portion may include an axially extending protrusion that engages the bearing housing.

In some configurations, the compressor includes a shell defining a discharge-pressure chamber and receiving compressed working fluid at the discharge pressure. The drive shaft and the bearing housing may be disposed within the discharge-pressure chamber. The biasing chamber may receive working fluid at an intermediate pressure between the suction pressure and the discharge pressure. The first annular seal may fluidly separate the discharge-pressure chamber from the biasing chamber.

In another form, the present disclosure provides a high-side compressor that may include a shell, orbiting and non-orbiting scrolls, a drive shaft, a bearing housing and a first annular seal. The shell may define a chamber containing discharge-pressure working fluid. The non-orbiting scroll is disposed within the chamber and includes a first spiral wrap. The orbiting scroll is disposed within the chamber and includes an end plate having a second spiral wrap ending from a first side of the end plate and an annular hub extending from a second side of the end plate. The first and second spiral wraps cooperate to compress working fluid from a suction pressure to a discharge pressure. The drive shaft is disposed within the chamber and includes a crankpin received in the hub and driving the orbiting scroll in an orbital path relative to the non-orbiting scroll. The bearing housing is disposed within the chamber and rotatably supports the drive shaft. The bearing housing defines a biasing chamber containing intermediate-pressure working fluid at a pressure greater than the suction pressure and less than the discharge pressure. The intermediate-pressure working fluid may bias the orbiting scroll toward the non-orbiting scroll in an axial direction. In some configurations, the first annular seal may sealingly engage a diametrical surface of the hub and sealingly engage the bearing housing, thereby defining the biasing chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
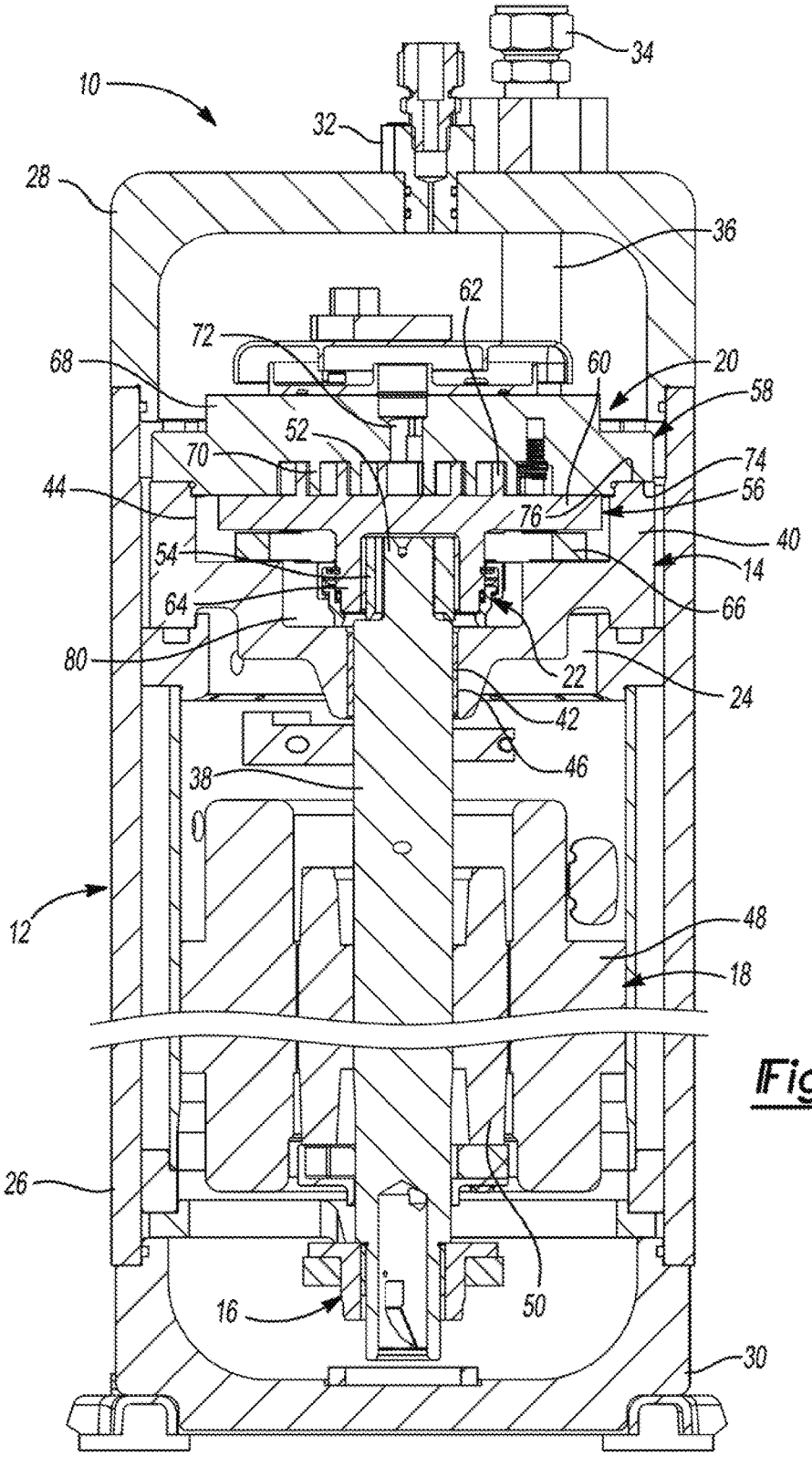
FIG. 1 is a cross-sectional view of a compressor having a seal assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-7, a compressor 10 is provided that may include a shell assembly 12, a first bearing assembly 14, a second bearing assembly 16, a motor assembly 18, a compression mechanism 20, and a seal assembly 22. The shell assembly 12 may define a high-pressure discharge chamber 24 and may include a cylindrical shell 26, an end cap 28 at an upper end thereof, and a base 30 at a lower end thereof. A discharge fitting 32 may be attached to the end cap 28 and is in fluid communication with the discharge chamber 24. A suction inlet fitting 34 may be attached to shell assembly 12 and may fluidly be connected to the compression mechanism by a suction conduit 36.

Figure 4:
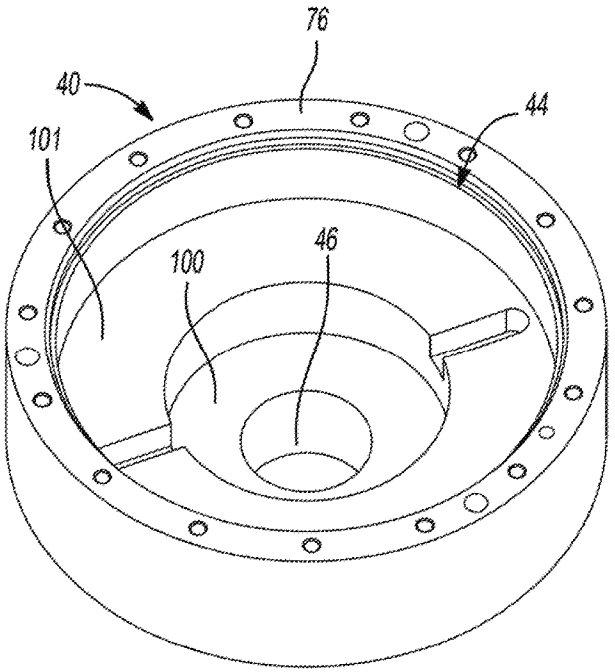
FIG. 4 is a perspective view of a bearing housing according to the principles of the present disclosure.

The first and second bearing assemblies 14, 16 may be fixed relative to the shell assembly 12 and may rotatably support respective ends of a drive shaft 38. The first bearing assembly 14 may be an upper bearing assembly and may include a first bearing housing 40 and a first bearing 42. As shown in FIG. 4, the first bearing housing 40 may be a generally bowl-shaped annular member. The first bearing housing 40 may define a stepped cavity 44 and an aperture 46 in which the first bearing 42 is received and through which the drive shaft 38 extends.

The motor assembly 18 may be disposed within the discharge chamber 24 and may include a motor stator 48 and a rotor 50. The motor stator 48 may be fixed relative to the shell assembly 12. The rotor 50 may be press fit on the drive shaft 38 and may transmit rotational power to the drive shaft 38. The drive shaft 38 may include an eccentric crank pin 52 received in a drive bushing 54. The crank pin 52 drives the compression mechanism 20.

The compression mechanism 20 may be disposed within the discharge chamber 24 and may include an orbiting scroll 56 and a non-orbiting scroll 58. The orbiting scroll 56 may include an end plate 60 having a spiral wrap 62 extending therefrom. A generally cylindrical hub 64 may project downwardly from the end plate 60. The hub 64 may receive the crank pin 52 and drive bushing 54. An Oldham coupling 66 may be engaged with the orbiting scroll 56 and the first bearing housing 40 to prevent rotation of the orbiting scroll 56.

The non-orbiting scroll 58 may include an end plate 68 and a spiral wrap 70 projecting downwardly from the end plate 68. The spiral wrap 70 may meshingly engage the spiral wrap 62 of the orbiting scroll 56, thereby creating a series of moving fluid pockets. The fluid pockets defined by the spiral wraps 62, 70 may decrease in volume as they move from a radially outer position (at a low pressure) to a radially intermediate position (at an intermediate pressure) to a radially inner position (at a high pressure) throughout a compression cycle of the compression mechanism 20. The end plate 68 may include a discharge passage 72 in communication with one of the fluid pockets at the radially inner position and allows compressed working fluid (at the high pressure) to flow into the discharge chamber 24.

The end plate 68 of the non-orbiting scroll 58 may include an annular ledge 74 that engages a radially outer rim 76 of the first bearing housing 40. A portion of the end plate 68 may be received in the cavity 44 of the first bearing housing 40. An annular seal 78 may engage the outer rim 76 and the end plate 68. The end plate 60 of the orbiting scroll 56 may be disposed within the cavity 44.

The seal assembly 22 sealingly engages the hub 64 of the orbiting scroll 56 and the first bearing housing 40. In this manner, non-orbiting scroll 58 and the first bearing housing 40 cooperate to define an annular chamber 80 (e.g., a biasing chamber) disposed radially between the seal 78 and the seal assembly 22. The end plate 60 of the orbiting scroll 56 may include one or more passages 82 (FIG. 2; only one shown) extending therethrough. Intermediate-pressure working fluid may be communicated from one or more intermediate-pressure fluid pockets (i.e., compression pockets defined by the spiral wraps 62, 70 that contain working fluid at a pressure greater than suction pressure and less than discharge pressure) to the chamber 80 through the one or more passages 82. Accordingly, the chamber 80 may contain intermediate-pressure working fluid that biases the orbiting scroll 56 in an axial direction (i.e., a direction along or parallel to a rotational axis of the drive shaft 38) toward the non-orbiting scroll 58.

As shown in FIGS. 2-7, the seal assembly 22 may include a first annular seal 84, a second annular seal 86, a spring (e.g., a wave ring) 88, a stop ring 90 and a seal retainer 92. At least a portion of the first annular seal 84 may extend around an outer diametrical surface 93 (e.g., an outer cylindrical surface) of the hub 64 of the orbiting scroll 56. The first annular seal 84 may include an inner circumference having first and second annular ledges 94, 96 that define annular recesses. A first axial end 98 of the first annular seal 84 may sealingly contact an axially facing surface 100 of the first bearing housing 40. A second axial end 102 of the first annular seal 84 may include a radially outwardly extending rim 104. The second axial end 102 may abut the spring 88 such that the spring 88 biases the first annular seal 84 into engagement with the surface 100 of the first bearing housing 40. The first annular ledge 94 and an annular ledge 106 (FIGS. 2 and 7) formed in the hub 64 may cooperate to define an annular space in which the second annular seal 86 is disposed. The second annular ledge 96 may define a radially inwardly extending protrusion 108 that may extend between the surface 100 of the first bearing housing 40 and an axially facing surface 110 of the hub 64. The protrusion 108 may be sized and positioned to provide a clearance between the second annular ledge 96 and the surface 110 to allow the orbiting scroll 56 to selectively axially separate from the non-orbiting scroll 58 (i.e., to allow the orbiting scroll 56 to move axially toward the surface 100 of the first bearing housing 40) to unload or modulate the capacity of the compressor 10.

Figure 7:
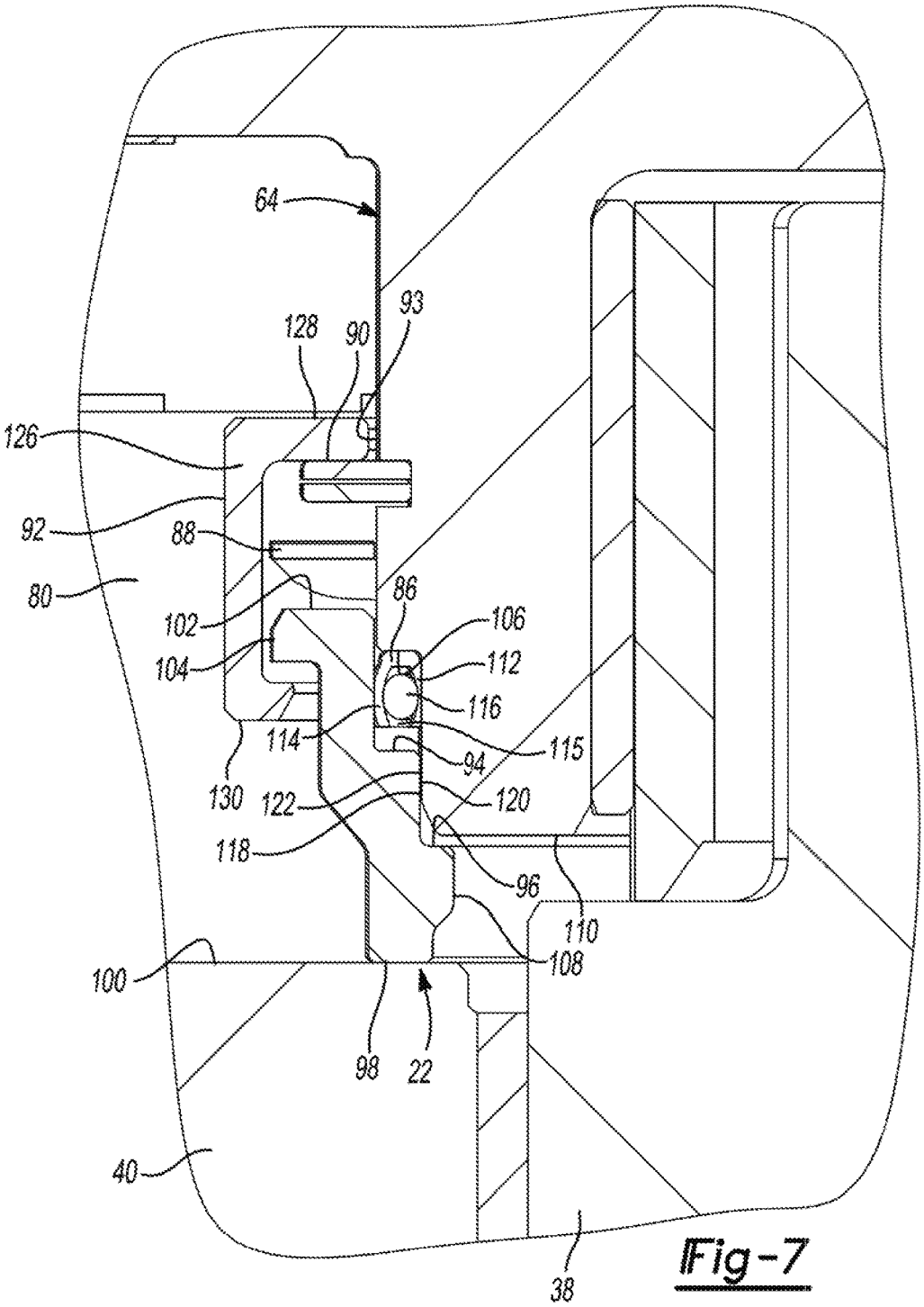
FIG. 7 is a partial cross-sectional view depicting a portion of the seal assembly.

As shown in FIG. 7, the second annular seal 86 may include inner and outer lips 112, 114 defining a generally U-shaped cross section. An opening 115 between the lips 112, 114 may face the first ledge 94 of the first annular seal 84. A gap 118 between adjacent surfaces 120, 122 of the first annular seal 84 and hub 64, respectively, may allow high-pressure working fluid from the discharge chamber 24 to flow into the opening 115, thereby spreading the lips 112, 114 apart from each other and biasing the lips 112, 114 into sealing contact with the first annular seal 84 and the hub 64. Additionally or alternatively, a biasing member 116 (e.g., an elastomeric O-ring, a metallic circular spring, etc.) may be disposed within the opening 115. The biasing member 116 may bias the lips 112, 114 into sealing contact with the first annular seal 84 and the hub 64.

The stop ring 90 may be received in an annular groove 124 in the hub 64. The annular groove 124 may be defined by annular ledges 125 (FIG. 5) that may abut the stop ring 90. The spring 88 may contact the stop ring 90 and the first annular seal 84 to bias the first annular seal toward the surface 100 of the first bearing housing 40, as described above.

The seal retainer 92 may be an annular collar having an axially extending portion 126, a first radially inwardly extending portion 128 extending from one end of the portion 126, and a second radially inwardly extending portion 130 extending from the other end of the portion 126. The first radially inwardly extending portion 128 may have an inner diameter that is smaller than an outer diameter of the stop ring 90 such that the first radially inwardly extending portion 128 can abut the stop ring 90. The second radially inwardly extending portion 130 may have an inner diameter that is smaller than an outer diameter of the rim 104 of the first annular seal 84 such that the second radially inwardly extending portion 130 can abut the rim 104. The inner diameter of the second radially inwardly extending portion 130 may be larger than the outer diameter of the stop ring 90.

Figure 3:
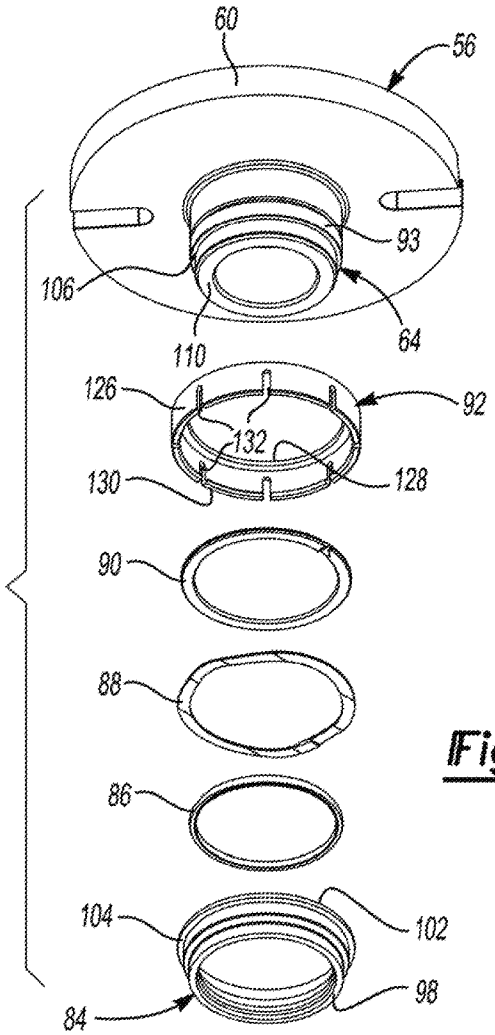
FIG. 3 is an exploded perspective view of an orbiting scroll and the seal assembly of the compressor of FIG. 1.
Figure 5:
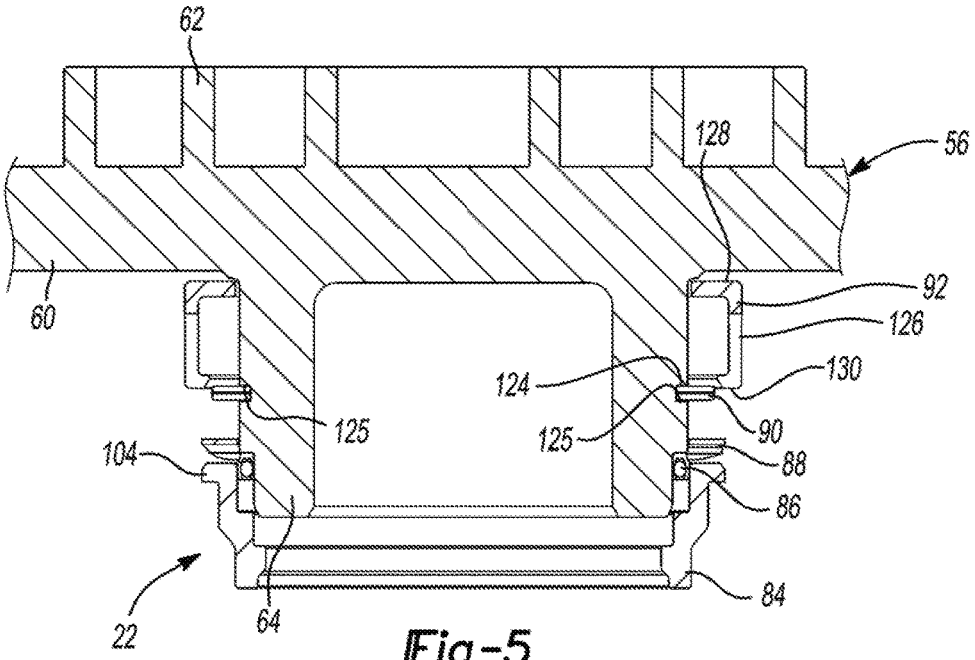
FIG. 5 is a partial cross-sectional view of the compressor of FIG. 1 with a seal retainer of the seal assembly in a first position.
Figure 6:
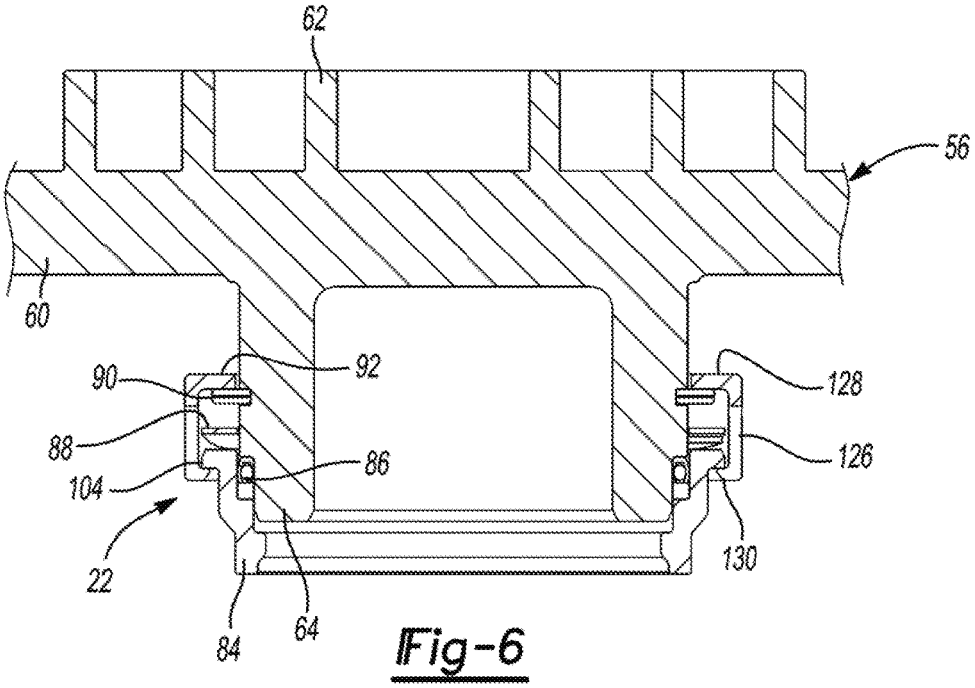
FIG. 6 is a partial cross-sectional view of the compressor of FIG. 1 with the seal retainer of the seal assembly in a second position.

The seal retainer 92 may retain the first and second annular seals 84, 86, spring 88 and stop ring 90 in place relative to the hub 64 during assembly of the compressor 10. That is, the seal retainer 92 can prevent the seals 84, 86 and the spring 88 from sliding off of the hub 64 before the orbiting scroll 56 is installed within the first bearing housing 40. As shown in FIG. 5, the seal retainer 92 can slide axially along the hub 64 to facilitate assembly of the stop ring 90, spring 88 and first and second seals 84, 86 onto the hub 64. As shown in FIG. 3, the axially extending portion 126 of the seal retainer 92 may include a plurality of slots 132 that allow the second radially inwardly extending portion 130 to resiliently flex in a radial direction relative to the first radially inwardly extending portion 128. In this manner, the seal retainer 92 can be slid down and snapped into engagement with the rim 104 of the first annular seal 84 to complete the assembly of the seal assembly 22 onto the hub 64, as shown in FIG. 6.

Figure 2:
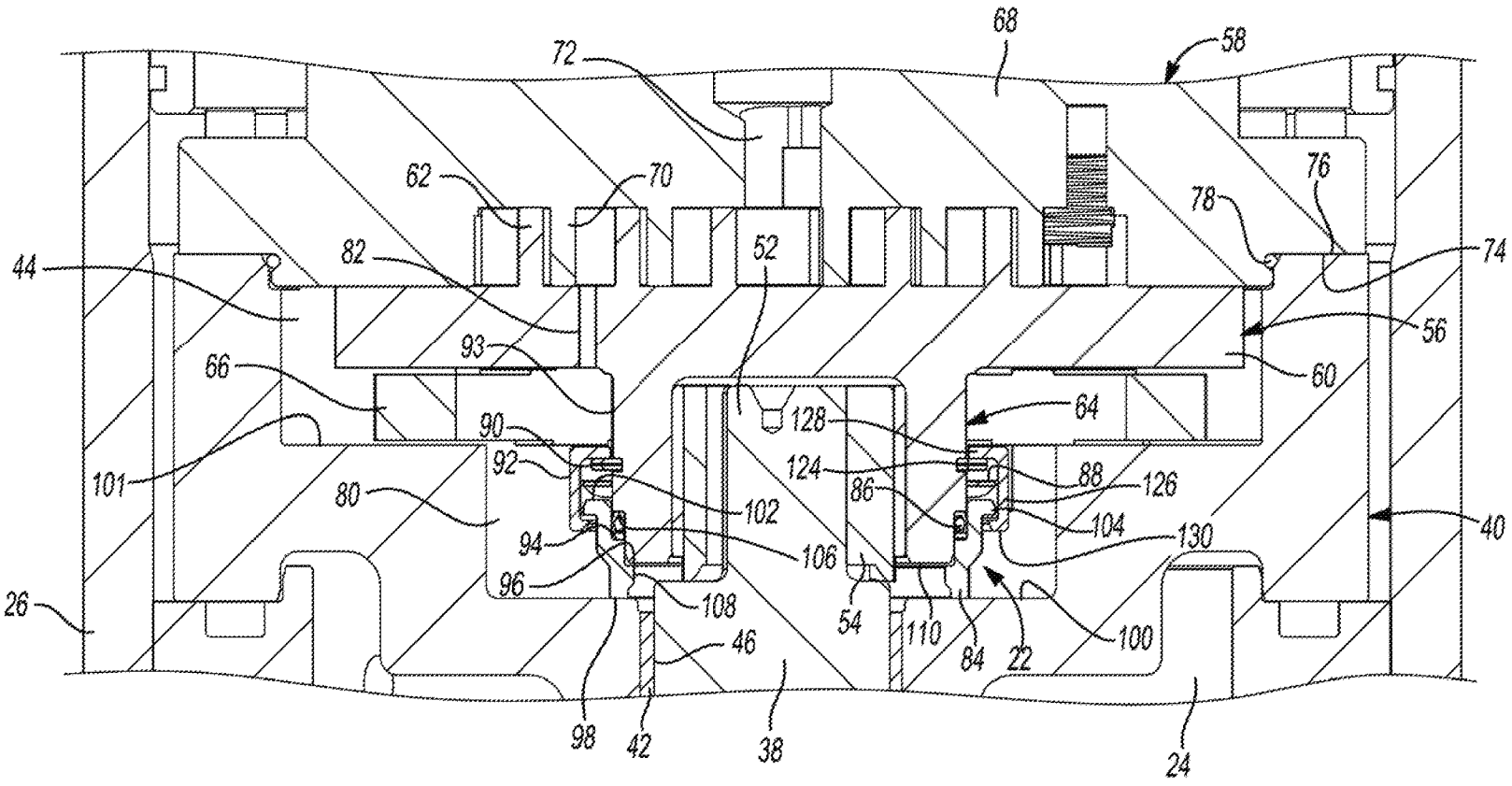
FIG. 2 is a partial cross-sectional view of the compressor of FIG. 1.

A shown in FIGS. 1 and 2, with the seal assembly 22 installed on the hub 64, the seal assembly 22 cooperates with the seal 78, the non-orbiting scroll 58 and the first bearing housing 40 to define the annular intermediate-pressure biasing chamber 80. That is, the intermediate-pressure biasing chamber 80 is disposed axially between the end plate 68 of the non-orbiting scroll 58 and axially facing surfaces 100, 101 of the first bearing housing 40; and the intermediate-pressure biasing chamber 80 is disposed radially between the seal 78 and the seal assembly 22. The seal assembly 22 separates the intermediate-pressure working fluid in the chamber 80 from high-pressure working fluid disposed inside of the hub 64 and around the drive shaft 38 by sealing against the outer circumference of the hub 64 and the surface 100 of the first bearing housing 40. The interface between the first axial end 98 of the first annular seal 84 and the surface 100 allows for a sealed relationship to be maintained between the seal assembly 22 and the first bearing housing 40 while still allowing the orbiting scroll 56 to orbit relative to the first bearing housing 40.

Figure 8:
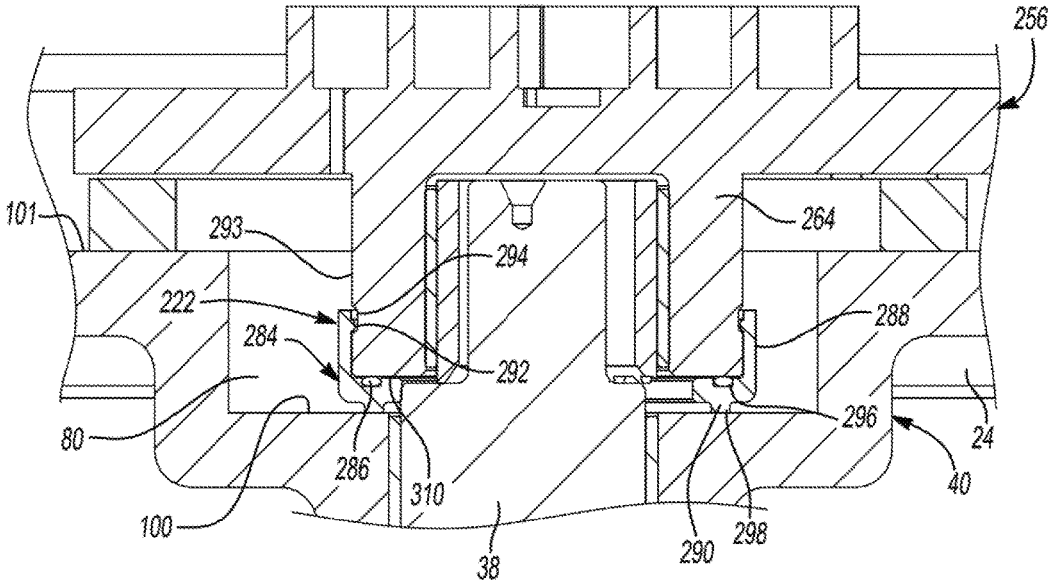
FIG. 8 is a partial cross-sectional view of a compressor having another seal assembly according to the principles of the present disclosure.

Referring now to FIG. 8, another seal assembly 222 and orbiting scroll 256 are provided that can be incorporated into the compressor 10 instead of the seal assembly 22 and orbiting scroll 56. Like the seal assembly 22, the seal assembly 222 sealingly engages a hub 264 of the orbiting scroll 256 and the surface 100 of the first bearing housing 40 to sealingly isolate the biasing chamber 80 from the discharge chamber 24 during orbital motion of the orbiting scroll 256 relative to the first bearing housing 40. The orbiting scroll 256 can be generally similar to the orbiting scroll 56, and therefore, similar features will not be described again in detail.

The seal assembly 222 may include a first annular seal 284 and a second annular seal 286. The first annular seal 284 may include an axially extending portion 288 and a radially inwardly extending portion 290. The axially extending portion 288 extends around and engages an outer diametrical surface 293 of the hub 264. The axially extending portion 288 may include an annular protrusion 292 that extends radially inward and may be received into an annular groove 294 formed in the surface 293 in the hub 264. Snap fitting the protrusion 292 into the groove 294 may removably retain the seal assembly 222 on the hub 264.

The radially inwardly extending portion 290 of the first annular seal 284 may include an annular recess 296 and an axially extending protrusion 298. The recess 296 may receive the second annular seal 286 such that the second annular seal 286 sealingly engages the first annular seal 284 and an axial end 310 of the hub 264. The second annular seal 286 may also provide an axial spring force to bias the first annular seal 284 away from the orbiting scroll 256 causing the axially extending protrusion 298 to sealingly engage the surface 100 of the first bearing housing 40.

Figure 9:
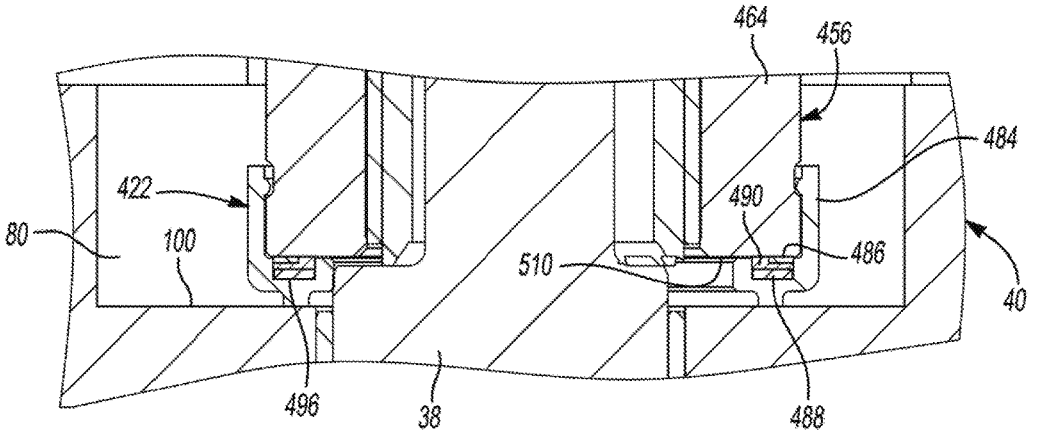
FIG. 9 is a partial cross-sectional view of a compressor having yet another seal assembly according to the principles of the present disclosure.

Referring now to FIG. 9, another seal assembly 422 and orbiting scroll 456 are provided that can be incorporated into the compressor 10 instead of the seal assembly 22 and orbiting scroll 56. Like the seal assemblies 22 and 222, the seal assembly 422 sealingly engages a hub 464 of the orbiting scroll 456 and the surface 100 of the first bearing housing 40 to sealingly isolate the biasing chamber 80 from the discharge chamber 24 during orbital motion of the orbiting scroll 456 relative to the first bearing housing 40. The orbiting scroll 456 can be generally similar to the orbiting scroll 56 or 256, and therefore, similar features will not be described again in detail.

The seal assembly 422 may include a first annular seal 484, a second annular seal 486, a spring 488 and a retainer 490. The first annular seal 484 may be similar to the first annular seal 284 and may sealingly contact the second annular seal 486. An annular groove 496 in the first annular seal 484 may receive the spring 488, the retainer 490 and the second annular seal 486. The second annular seal 486 may be received within the retainer 490. The spring 488 may be disposed between the retainer 490 and a lower axial end of the groove 496 so that the spring 488 biases the second annular seal 486 into sealing engagement with an axial end 510 of the hub 464.

Figure 10:
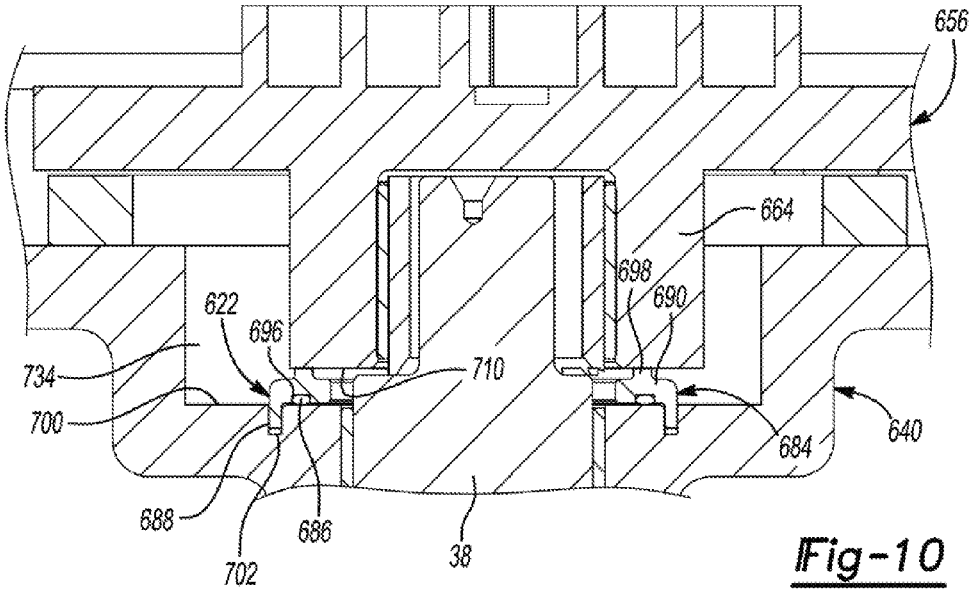
FIG. 10 is a partial cross-sectional view of a compressor having yet another seal assembly according to the principles of the present disclosure.

Referring now to FIG. 10, another seal assembly 622, bearing housing 640 and orbiting scroll 656 are provided that can be incorporated into the compressor 10 instead of the seal assembly 22, bearing housing 40 and orbiting scroll 56. Like the seal assemblies 22, 222, 422, the seal assembly 622 sealingly engages a hub 664 of the orbiting scroll 656 and the bearing housing 640 to sealingly isolate a biasing chamber 734 from the discharge chamber 24 during orbital motion of the orbiting scroll 656 relative to the bearing housing 640. However, unlike the seal assemblies 22, 222, 422, the orbiting scroll 656 orbits relative to the seal assembly 622 and the seal assembly 622 remains stationary relative to the bearing housing 640. The orbiting scroll 656 can be generally similar to the orbiting scroll 56, 256, 456, and therefore, similar features will not be described again in detail. The bearing housing 640 can be generally similar to the bearing housing 40, apart from exceptions described below.

The seal assembly 622 may include a first annular seal 684 and a second annular seal 686. The first annular seal 684 may include an axially extending portion 688 and a radially inwardly extending portion 690. The axially extending portion 688 extends into an annular groove 702 formed in surface 700 of the bearing housing 640 and engages the bearing housing 640.

The radially inwardly extending portion 690 of the first annular seal 684 may include an annular recess 696 and an axially extending protrusion 698. The recess 696 may receive the second annular seal 686 such that the second annular seal 686 sealingly engages the first annular seal 684 and an axial end the surface 700 of the bearing housing 640. The second annular seal 686 may also provide an axial spring force to bias the first annular seal 684 away from the first bearing housing 640 causing the axially extending protrusion 698 to sealingly engage an axial end 710 of the hub 664.

Figure 11:
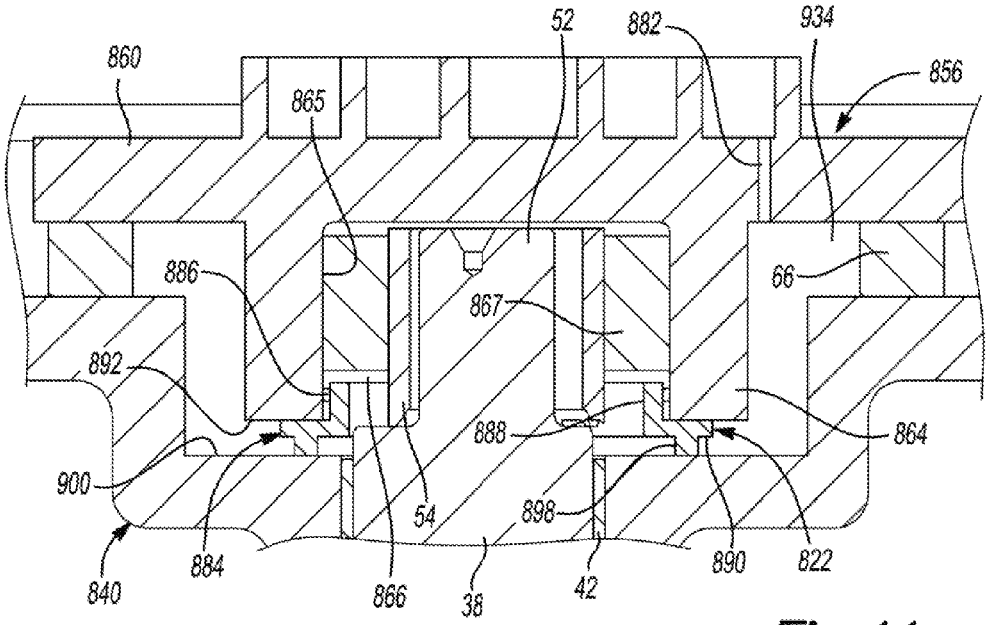
FIG. 11 is a partial cross-sectional view of a compressor having yet another seal assembly according to the principles of the present disclosure.

Referring now to FIG. 11, another seal assembly 822, bearing housing 840 and orbiting scroll 856 are provided that can be incorporated into the compressor 10 instead of the seal assembly 22, bearing housing 40 and orbiting scroll 56. Like the seal assemblies 22, 222, 422, 622 the seal assembly 822 sealingly engages a hub 864 of the orbiting scroll 856 and the bearing housing 840 to sealingly isolate a biasing chamber 934 from the discharge chamber 24 during orbital motion of the orbiting scroll 856 relative to the bearing housing 840. Like the seal assemblies 22, 222, 422, the seal assembly 822 orbits with the orbiting scroll 856 relative to the bearing housing 840. The orbiting scroll 856 can be similar or identical to the orbiting scroll 56, 256, 456 656, and therefore, similar features will not be described again in detail. The bearing housing 840 can be similar or identical to the bearing housing 40 and, while not shown in FIG. 11, may be sealingly engaged with the non-orbiting scroll 58 via seal 78 in the manner described above. As described above, the biasing chamber 934 may be defined by and is sealingly contained between the seal 78 and the seal assembly 822. As described above, a passage 882 in an end plate 860 of the orbiting scroll 856 may provide fluid communication between an intermediate-pressure fluid pocket and the biasing chamber 934.

The seal assembly 822 may include a first annular seal 884 and a second annular seal 886. The first annular seal 884 may include an axially extending portion 888 and a radially extending portion 890. The axially extending portion 888 may extend into the hub 864 of the orbiting scroll 856 (i.e., into a cavity 866 of the hub 864 in which the crankpin 52, the bushing 54 and a bearing 867 are received) and may sealingly engage (either directly or indirectly via the second annular seal 886) an inner diametrical surface 865 (i.e., an inner cylindrical surface) of the hub 864. The bearing 867 may be disposed axially between the axially extending portion 888 of the first annular seal 884 and the end plate 860 of the orbiting scroll 856. The bearing 867 may be a rolling element bearing, for example, and may engage the inner diametrical surface 865 and the bushing 54.

The radially extending portion 890 of the first annular seal 884 may extend radially outward from an end of the axially extending portion 888 and may be disposed axially between an axial end 892 of the hub 864 and an axially facing surface 900 of the bearing housing 840. The radially extending portion 890 may include an axially extending protrusion 898 that sealingly engages the axially facing surface 900 of the bearing housing 840. The protrusion 898 may slide along the axially facing surface 900 as the orbiting scroll 856 and the seal assembly 822 orbit relative to the bearing housing 840.

The second annular seal 886 may be received within the hub 864 (i.e., within the cavity 866) and may be disposed radially between the axially extending portion 888 of the first annular seal 884 and the inner diametrical surface 865 of the hub 864 such that the second annular seal 886 sealingly engages the axially extending portion 888 and the inner diametrical surface 865. In some configurations, the second annular seal 886 may be similar or identical to the second annular seal 86. Alternatively, the second annular seal 886 could be an O-ring having a solid, round cross section, for example. It will be appreciated that the second annular seal 886 could have other alternative shapes and configurations.

As described above, the bearing 867 shown in FIG. 11 may be a rolling element bearing, and therefore, may be radially wider than a typical journal bearing (shown in FIGS. 1-10). To accommodate the larger radial width of the bearing 867, the hub 864 may need to be radially wider. The configuration of the seal assembly 822 (e.g., sealingly engaging the inner diametrical surface 865 of the hub 864) is well-suited for such configurations, as the seal assembly 822 provides additional radial clearance between the hub 864 and the bearing housing 840 to accommodate the wider orbital path of the hub 864 while still providing an adequate seal between the hub 864 and the bearing housing 840.

While the compressor 10 is described above as being a high-side compressor, it will be appreciated that any of the seal assemblies 22, 222, 422, 622, 822 could be incorporated into a low-side compressor. In some configurations, the compressor 10 may include some form of capacity modulation, such as digital modulation (i.e., axial scroll separation) and/or vapor injection, for example, to vary the output of the compressor 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a non-orbiting scroll including a first spiral wrap;

an orbiting scroll including an end plate having a second spiral wrap ending from a first side of said end plate and an annular hub extending from a second side of said end plate, said first and second spiral wraps cooperating to compress working fluid from a suction pressure to a discharge pressure;

a drive shaft having a crankpin received in said hub and driving said orbiting scroll in an orbital path relative to said non-orbiting scroll;

a bearing housing rotatably supporting said drive shaft and defining a biasing chamber containing working fluid biasing said orbiting scroll toward said non-orbiting scroll in an axial direction; and a first annular seal engaging a diametrical surface of said hub and engaging said bearing housing, thereby defining said biasing chamber, wherein said diametrical surface is a radially outwardly facing surface of said hub.

2. The compressor of claim 1, wherein said working fluid disposed within said biasing chamber is at an intermediate pressure between said suction pressure and said discharge pressure, and wherein said first annular seal separates said working fluid disposed within said biasing chamber from discharge-pressure working fluid disposed in a space radially inward relative to said first annular seal.

3. The compressor of claim 1, wherein said first annular seal defines an annular space in which a second annular seal is disposed, said second annular seal sealingly engaging said first annular seal and said hub.

4. The compressor of claim 3, wherein said second annular seal sealingly engages said diametrical surface of said hub.

5. The compressor of claim 4, further comprising a spring disposed within said annular space in said first annular seal and biasing said second annular seal into engagement with said hub and said first annular seal.

6. The compressor of claim 3, wherein said second annular seal sealingly engages an axial end surface of said hub.

7. The compressor of claim 6, wherein an axially extending portion of said first annular seal includes a radially inwardly extending protrusion that is received in an annular groove formed in said hub.

8. The compressor of claim 1, further comprising a stop ring disposed between said first annular seal and said end plate, said stop ring extending around said hub and abutting an annular ledge formed in said hub.

9. The compressor of claim 8, further comprising a spring disposed between said stop ring and said first annular seal and biasing said first annular seal and said stop ring away from each other in an axial direction.

10. The compressor of claim 9, further comprising a second annular seal disposed radially inward relative to at least a portion of said first annular seal, said second annular seal sealingly engaging said first annular seal and said hub.

11. The compressor of claim 10, further comprising an annular seal retainer extending around said hub and cooperating with said hub to define an annular cavity disposed radially therebetween, wherein said stop ring, said spring and a portion of said first annular seal are disposed within said annular cavity.

12. The compressor of claim 11, wherein said seal retainer is movable along said hub in an axial direction and includes an axial end having a radially inwardly extending lip that snaps into engagement with a radially outwardly extending lip of said first annular seal.

13. The compressor of claim 12, wherein said second annular seal sealingly engages another annular ledge of said hub.

14. The compressor of claim 13, wherein said second annular seal includes a generally U-shaped cross section that is exposed to discharge-pressure working fluid that spreads said U-shaped cross section open to seal said second annular seal against said hub and said first annular seal.

15. The compressor of claim 1, wherein said non-orbiting scroll sealingly engages said bearing housing at a location disposed radially outward relative to said first annular seal such that said biasing chamber is disposed radially between said first annular seal and said location.

16. The compressor of claim 1, further comprising a shell defining a discharge-pressure chamber and receiving compressed working fluid at said discharge pressure, wherein said drive shaft and said bearing housing are disposed within said discharge-pressure chamber, wherein said biasing chamber receives working fluid at an intermediate pressure between said suction pressure and said discharge pressure, and wherein said first annular seal fluidly separates said discharge-pressure chamber from said biasing chamber.

17. A compressor comprising:

a non-orbiting scroll including a first spiral wrap;

an orbiting scroll including an end plate having a second spiral wrap ending from a first side of said end plate and an annular hub extending from a second side of said end plate, said first and second spiral wraps cooperating to compress working fluid from a suction pressure to a discharge pressure;

a drive shaft having a crankpin received in said hub and driving said orbiting scroll in an orbital path relative to said non-orbiting scroll;

a bearing housing rotatably supporting said drive shaft and defining a biasing chamber containing working fluid biasing said orbiting scroll toward said non-orbiting scroll in an axial direction; and a first annular seal engaging a diametrical surface of said hub and engaging said bearing housing, thereby defining said biasing chamber, wherein said diametrical surface of said hub is an outer diametrical surface.

18. The compressor of claim 17, further comprising a second annular seal disposed radially inward relative to at least a portion of said first annular seal, said second annular seal sealingly engaging said first annular seal and said hub.

19. The compressor of claim 18, wherein said second annular seal includes a generally U-shaped cross section that is exposed to discharge-pressure working fluid that spreads said U-shaped cross section open to seal said second annular seal against said hub and said first annular seal.

20. The compressor of claim 18, further comprising: a stop ring disposed between said first annular seal and said end plate, said stop ring extending around said hub and abutting an annular ledge formed in said hub; a spring disposed between said stop ring and said first annular seal and biasing said first annular seal and said stop ring away from each other in an axial direction; and an annular seal retainer extending around said hub and cooperating with said hub to define an annular cavity disposed radially therebetween, wherein said stop ring, said spring and a portion of said first annular seal are disposed within said annular cavity, and wherein said annular seal retainer is movable along said hub in an axial direction and includes an axial end having a radially inwardly extending lip that snaps into engagement with a radially outwardly extending lip of said first annular seal.

* * * * *